US009067711B2

(12) United States Patent
Melia

(10) Patent No.: US 9,067,711 B2
(45) Date of Patent: Jun. 30, 2015

(54) STORAGE AND DISPENSING DEVICE

(71) Applicant: Sonoco Development, Inc., Hartsville, SC (US)

(72) Inventor: Paul M. Melia, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/670,112

(22) Filed: Nov. 6, 2012

(65) Prior Publication Data

US 2014/0124533 A1 May 8, 2014

(51) Int. Cl.

| | |
|---|---|
| ***B65D 35/56*** | (2006.01) |
| ***B65D 35/30*** | (2006.01) |
| ***B05C 17/005*** | (2006.01) |
| ***B05C 17/01*** | (2006.01) |

(52) U.S. Cl.

CPC ..... *B65D 35/30* (2013.01); *B05C 17/00583* (2013.01); *B05C 17/00596* (2013.01); *B05C 17/0123* (2013.01)

(58) Field of Classification Search

CPC ..... B65D 83/0072; B65D 83/0055; B65D 77/065; B65D 25/48; B65D 47/122; B65D 35/28; B65D 35/30; B05C 17/00516; B05C 17/00574; B05C 17/00583; B05C 17/00596; B05C 17/0123

USPC ..... 222/92–107, 322–327, 566–570, 222/153.11, 153.13, 391

See application file for complete search history.

(56) References Cited

U.S. PATENT DOCUMENTS

| | | | | |
|---|---|---|---|---|
| 1,235,550 | A * | 8/1917 | Carmody | 222/386.5 |
| 1,607,501 | A * | 11/1926 | Anderson | 222/93 |
| 1,965,271 | A | 7/1934 | Wharton | |
| 2,037,989 | A | 4/1936 | Macklanburg | |
| 2,105,039 | A | 1/1938 | Hulme | |
| 2,733,836 | A | 2/1956 | Switzer | |
| 3,069,053 | A | 12/1962 | Nilson | |
| 3,162,337 | A | 12/1964 | Sabaka | |
| 3,212,679 | A | 10/1965 | Schmidt, Jr. | |
| 3,323,682 | A | 6/1967 | Creighton, Jr. et al. | |

(Continued)

FOREIGN PATENT DOCUMENTS

| | | |
|---|---|---|
| DE | 4333812 A1 | 4/1995 |
| GB | 1118355 | 7/1968 |

(Continued)

OTHER PUBLICATIONS

EP Search Report, Appln. No. 13190975.6, dated May 13, 2015.

*Primary Examiner* — Frederick C Nicolas
*Assistant Examiner* — Bob Zadeh
(74) *Attorney, Agent, or Firm* — Flaster/Greenberg P.C.

(57) ABSTRACT

An assembly is provided for storing and dispensing flowable material. The assembly includes a reusable tube dimensionally formed to fit within the body of a dispensing gun. A separate pouch member is provided for storing a quantity of flowable material and is formed to be removably positioned within the tube. A nozzle is provided on the pouch for directing discharge of the material from the pouch. The pouch is provided with a fitment at one end. Cooperative elements are formed between the end wall of the tube and the fitment, which engage upon insertion of the pouch into the tube. A disk is provided for removable attachment to the plunger portion of the gun. A hook or gripping device projects from the disk for engagement of the end of the pouch.

22 Claims, 6 Drawing Sheets

(56) References Cited

U.S. PATENT DOCUMENTS

| | | | | | |
|---|---|---|---|---|---|
| 3,439,839 | A | | 4/1969 | Schumann et al. | |
| 3,730,394 | A | | 5/1973 | Woodson | |
| 3,933,272 | A | * | 1/1976 | Lamb et al. | 222/1 |
| 3,933,273 | A | | 1/1976 | Cox | |
| 4,299,329 | A | | 11/1981 | Keiji | |
| 4,411,656 | A | | 10/1983 | Cornett, III | |
| 4,706,853 | A | | 11/1987 | Stonesifer et al. | |
| 4,732,299 | A | * | 3/1988 | Hoyt | 222/94 |
| 4,741,462 | A | | 5/1988 | Schneider, Jr. | |
| 4,869,403 | A | | 9/1989 | Brüning | |
| 5,076,475 | A | * | 12/1991 | Dutt | 222/530 |
| 5,141,500 | A | * | 8/1992 | Hake | 604/198 |
| 5,301,835 | A | * | 4/1994 | Fulks et al. | 222/95 |
| 5,301,840 | A | * | 4/1994 | Sun | 222/109 |
| 5,332,122 | A | | 7/1994 | Herold et al. | |
| 5,370,271 | A | | 12/1994 | Segatz | |
| 5,370,282 | A | | 12/1994 | Sedlmeier | |
| 5,419,460 | A | | 5/1995 | Herold et al. | |
| 5,454,896 | A | * | 10/1995 | Harding et al. | 156/156 |
| 5,650,180 | A | * | 7/1997 | Kumada et al. | 425/376.1 |
| 5,680,967 | A | | 10/1997 | Dang et al. | |
| 6,068,164 | A | | 5/2000 | Totaro | |
| 6,209,755 | B1 | | 4/2001 | Mühlbauer | |
| 6,234,348 | B1 | * | 5/2001 | Okamura et al. | 222/1 |
| 6,435,373 | B1 | * | 8/2002 | Mizrahi | 222/105 |
| 6,464,112 | B2 | | 10/2002 | Summons et al. | |
| 6,705,756 | B2 | * | 3/2004 | Botrie et al. | 366/181.5 |
| 6,892,904 | B2 | | 5/2005 | Osborn et al. | |
| 6,958,033 | B1 | * | 10/2005 | Malin | 493/102 |
| 7,445,135 | B2 | * | 11/2008 | Miyata et al. | 222/326 |
| 7,823,753 | B2 | | 11/2010 | Kovac | |
| 7,913,883 | B1 | * | 3/2011 | Kaufman | 222/477 |
| 2005/0029314 | A1 | | 2/2005 | Williams et al. | |
| 2007/0158370 | A1 | | 7/2007 | Longo, III | |
| 2010/0230438 | A1 | | 9/2010 | Sardo, Jr. | |
| 2011/0089192 | A1 | | 4/2011 | McMahon et al. | |
| 2011/0091590 | A1 | | 4/2011 | McMahon et al. | |

FOREIGN PATENT DOCUMENTS

| | | | |
|---|---|---|---|
| GB | 2186544 | A | 8/1987 |
| JP | 3200576 | A | 9/1991 |
| JP | 3056663 | U | 12/1998 |
| JP | 3059915 | U | 4/1999 |
| JP | 2002-104448 | A | 4/2002 |
| JP | 2005-104158 | A | 4/2005 |

* cited by examiner

STORAGE AND DISPENSING DEVICE

FIELD OF THE INVENTION

The present application relates to a storage and dispensing device for flowable materials, such as caulk or other viscous, flowable liquids or slurries. The device is constructed of multiple components and includes a removable pouch for retaining a material charge.

BACKGROUND OF THE INVENTION

In storage and dispensing of adhesives and sealants, there is a need for packaging that will keep the stored material usable and that will permit discharge, when desired. One form of package for viscous, flowable materials, such as caulk or similar adhesives, is a composite cartridge, typically having a foil barrier therein. Another form of packaging for caulk-like materials is a plastic cartridge, typically having a multilayer barrier construction or a monolayer with a post fluorinated option. One potential problem in the storage of barrier composite tubes is that water absorption may result in poor package performance. In the plastic tube option, economics and barrier/product compatibility have been significant drivers in the choice of materials.

SUMMARY OF THE INVENTION

The present disclosure is related to a device for storing and dispensing flowable material. The device is formed for operation along with a dispensing mechanism of the type having a piston or plunger, a driving mechanism for linearly moving the plunger in a controlled manner, and a retaining body. The device in one embodiment is in the form of a cartridge assembly having a reusable tube dimensionally formed to fit within the body of the dispensing mechanism. A separate pouch is provided for storing a quantity of flowable material and is formed to be removably positioned within the tube. A nozzle is removably attachable to the pouch for directing discharge of the material from the pouch. In addition to receiving the pouch, the tube defines an interior passage for receipt of the plunger during activated movement. The pouch may be provided with a fitment at one end and the opposite end forming a closure. The fitment may include means for cooperative engagement between the end wall of the tube, upon insertion of the pouch into the tube. Means may also be provided for removably connecting the nozzle to the pouch. In the present aspect of the device, the cartridge is formed by the assembly of the tube with the pouch therein, and the nozzle is secured on the fitment. The driving mechanism of the dispensing device is received within the tube and engages the sealed end of the pouch. The linear movement of the plunger compresses the pouch within the tube and forces the material from the pouch, through the nozzle.

In a further aspect of the device, the fitment end of the pouch may include an exterior surface having threads thereon, forming the removable connecting means for the nozzle. The nozzle may further include an interior surface containing threads for engagement of the external threads on the fitment. Similar combinations and structures are also possible.

In a further aspect of the device, the engagement means on the fitment end of the pouch may include a plurality of projecting ridges. In addition, the tube may include a plurality of grooves formed on an internal surface of the end wall. The ridges on the fitment and the grooves on the end wall are formed for cooperative engagement and to frictionally retain the radial or rotated position of the pouch within the tube. Similar combinations and arrangements are possible to achieve this function.

In a still further aspect of the device, means may be provided for removably securing the plunger and piston to the sealed end of the pouch. The securing means may be formed as a disk that is removably attached to the plunger and may include a hook or other gripping device for engagement of the pouch. In one aspect of the device, the sealed end of the pouch may include a hole therein for receipt of the hook or gripping device on the disk. A closure arm may further be included to maintain engagement with the sealed end of the pouch. The closure arm may be resiliently formed to permit selective release of the pouch from the hook or gripping device.

In another aspect of the device, the pouch may be formed with a flexible sidewall and the fitment may be a molded part that is secured to the sidewall. Further, the tube may be formed from a molded cylindrical sidewall and a molded end wall. The end of the tube that is opposite the end wall forms an open receiving end.

In another aspect of the disclosure, a cartridge assembly is provided for storing and dispensing flowable material. The device is formed for operation along with a dispensing gun having a piston or plunger, a driving mechanism for linearly moving the plunger in a controlled manner, and a retaining body. The cartridge assembly is formed from a tube, a storage pouch and a nozzle. The tube is defined as having an elongated, hollow body formed by a cylindrical sidewall positioned about a central longitudinal axis. The tube includes an open first end, an end wall at an opposite end, and an opening in the end wall. The tube is dimensionally formed to fit within the body of a dispensing gun. The tube defines an interior passage for receipt of the pouch and for receipt of the plunger during movement thereof. A separate pouch is provided for storing a quantity of material. A temporary seal is provided on the opening. The pouch is formed with an outer dimension that is less than the dimension of the interior passage of the tube. The pouch has a flexible sidewall, a fitment secured to one end, and a closed opposite end. The fitment forms a pouch end wall and includes a discharge opening therein. The pouch may be removably positioned within the tube, with the fitment in contact with the tube end wall. A nozzle is provided and may be removably attached adjacent the discharge opening. The nozzle is formed for directing discharge of the material from the pouch. In addition, an engagement disk is provided and may be removably secured to the plunger. A fastener is provided for securing the disk to the sealed end of the pouch. During operation of the dispensing gun, the driving mechanism is received within the tube and the plunger engages the sealed end of the pouch. The disk is provided between the plunger and the pouch and is secured to the sealed end of the pouch. Movement of the plunger causes compression of the pouch within the tube and forces material from the pouch, through the discharge opening and through the nozzle.

In a further aspect of the cartridge assembly, means is provided for cooperative engagement of the pouch fitment and the end wall of the tube. The engagement results in a fixing of the rotated position of the pouch within the hollow of the tube upon assembly.

In a further aspect of the cartridge assembly, the sealed end of the pouch may include a hole or opening therein and the fastener comprises an engagement hook or gripping device on the disk, wherein the hook or gripping device engages the pouch, such as in a provided opening, to secure the disk to the pouch.

In a further aspect of the cartridge assembly, the fitment may include a projection surrounding the discharge opening.

The nozzle may removably engage the projection. The projection may include threads thereon for engaging a corresponding threaded portion on the nozzle.

In a further aspect of the cartridge assembly, the engagement means on the end wall may be formed by a plurality of grooves and a correspondingly positioned plurality of ridges on respective surfaces of the fitment of the pouch and the end wall of the tube. The grooves are preferably formed to receive the ridges and to frictionally retain the radial position of the pouch within the tube.

In a further aspect of the disclosure, a cartridge assembly is provided for storing and dispensing flowable material for operation in conjunction with a dispensing gun. The cartridge assembly is formed from a tube, a storage pouch and a nozzle. The tube is defined as having an elongated, hollow body formed by a cylindrical sidewall positioned about a central longitudinal axis. The tube includes an open first end, an end wall at an opposite end, and an opening in the end wall. The tube is dimensionally formed to fit within the body of a dispensing gun to defining an interior passage for receipt of the pouch and for receipt of a plunger from the dispensing gun. A separate pouch is provided for storing a quantity of material. The pouch is formed with an outer dimension that is less than the dimension of the interior passage of the tube. The pouch has a flexible sidewall, a fitment secured to one end and a closed opposite end. The fitment forms a pouch end wall and includes a discharge opening therein. The pouch may be removably positioned within the tube, with the fitment in contact with the tube end wall. A nozzle is provided and may be removably attached adjacent the discharge opening. The nozzle is formed for directing discharge of the material from the pouch. The pouch fitment and the end wall of the tube include means for cooperative engagement, serving to fix the rotated position of the pouch within the hollow of the tube upon assembly. During operation of the dispensing gun, the driving mechanism is received within the tube and engages the sealed end of the pouch. The linear movement of the plunger compresses the pouch within the tube and forces the material from the pouch, through the discharge opening and through the nozzle.

In a further aspect of the cartridge assembly, the engagement means may include a plurality of grooves and a correspondingly positioned plurality of ridges formed on the fitment of the pouch and on the end wall of the tube. The grooves are formed to align with and receive the ridges, thereby frictionally maintaining the radial position of the pouch within the tube. The cartridge assembly may further include means removably securing the piston to the sealed end of the pouch. The securing means may be in the form of a disk for removable attachment to the piston and a hook or gripping device for engagement of the pouch. The sealed end of the pouch may include a hole or opening therein for receipt of the engagement hook or gripping device.

In a further aspect of the disclosure, a cartridge assembly is provided and includes a rigid tube defined by a sidewall formed about a longitudinal axis, an open first end, and an end wall at the opposite end. An opening is provided in the end wall and a hollow interior is defined by the sidewall. A separate pouch is provided for storing a quantity of material. The pouch includes a fitment secured to one pouch end and a closed opposite end. The fitment forms a pouch end wall and includes a hollow projection extending therefrom. The projection is dimensioned to extend through the opening in the tube end wall. A nozzle is provided and may be removably attached to the fitment. The nozzle is formed for directing the discharge of material from the pouch. The pouch preferably defines an outer dimension that is less than the dimension of the hollow interior of the tube so that the pouch may be removably positioned within the tube, with the fitment positioned adjacent the end wall of the tube. The end wall and the fitment include means for cooperative engagement with one another to fix the rotated position of the pouch within the hollow of the tube.

In a further aspect of the cartridge assembly, the fitment projection includes an exterior surface having threads thereon forming a removable securing means for the nozzle. The nozzle may further include an interior surface containing threads for engagement of the external threads of the fitment projection.

In a further aspect of the cartridge assembly, the cooperative means on the fitment and end wall of the tube may include a plurality of projecting ridges and a similarly arranged plurality of grooves. The ridges engage the grooves for frictionally maintaining the rotated position of the pouch within the tube.

In a further aspect of the cartridge assembly, a disk is provided for removable attachment to the end of the pouch opposite of the fitment. The opposite end of the pouch may be provided with a hole or opening therein for receipt of an engagement hook, gripping device or the like, which may be formed on the disk.

In a further aspect of the cartridge assembly, the tube may be formed with a molded cylindrical sidewall and a molded end wall attached to the sidewall.

Other features of the present invention will become apparent from the detailed description to follow, taken in conjunction with the accompanying drawings.

BRIEF DESCRIPTION OF THE DRAWINGS

For the purpose of illustrating the invention, the drawings show one or more forms that are presently preferred. It should be understood that the invention is not limited to the precise arrangements and instrumentalities shown.

DETAILED DESCRIPTION

Figure 1:
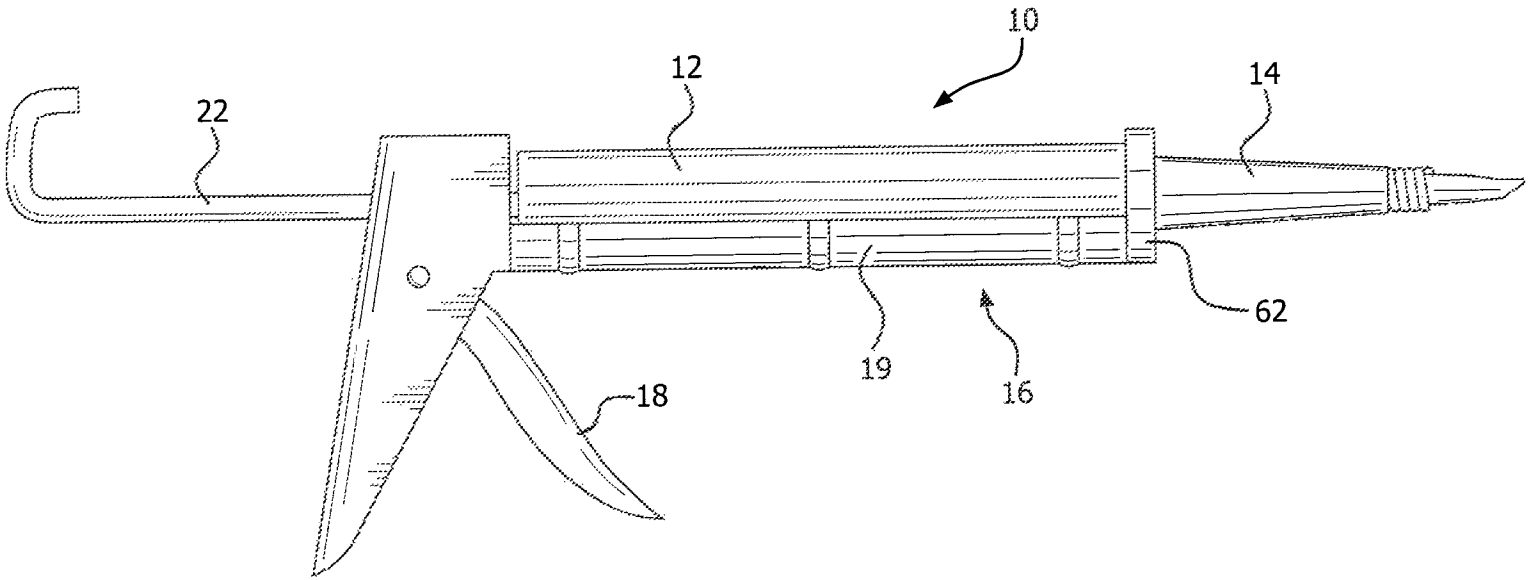
FIG. 1 shows a storage and dispensing device in one form contemplated by the present disclosure, with the device positioned within a dispensing activation mechanism.

In the figures, where like numerals identify like elements, there is shown an embodiment of a storage and dispensing device as contemplated by the present disclosure. In FIG. 1, the device is in the form of a cartridge assembly and is generally designated by the numeral 10. The cartridge assembly 10 is formed by a number of elements, including an outer tube 12 and a dispensing nozzle 14. Additional elements of the device will be discussed further below with reference to the other figures. The nozzle 14 projects from one end of the outer tube 12. The tube 12 forms a reusable portion of the cartridge assembly 10 and is dimensioned to fit within a discharge activation mechanism 16. The discharge mechanism 16 as shown is in the form of a typical caulk gun. The cartridge assembly 10 is positioned within a body or retaining portion 19 of the gun 16, with the nozzle 14 projecting from the discharge end of the gun 16. The gun 16 includes a trigger or activation mechanism 18 that functionally causes linear movement of a piston or plunger (see element 20 in FIG. 5) located on the end of a driving mechanism, which as shown is in the form of a piston shaft 22. Movement of the plunger (20) results in discharge of stored material through the nozzle 14.

Figure 2:
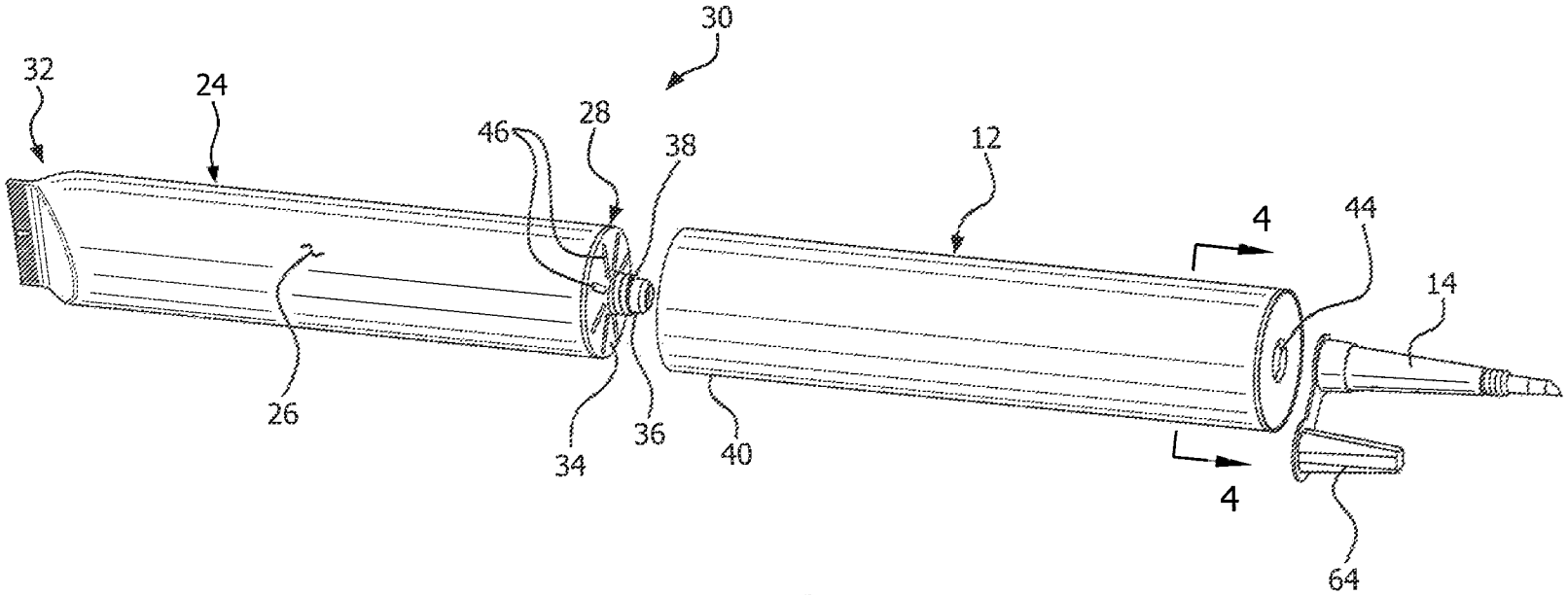
FIG. 2 shows an exploded view of the embodiment of a storage and dispensing device of FIG. 1.

FIG. 2 shows the constituent parts of the cartridge assembly 10. The tube 12 forms an outer sleeve for a pouch 24. The pouch 24 serves as the storage device for retaining material prior to discharge. The pouch 24 is preferably formed having a flexible sidewall 26 and a fitment 28 secured at a discharge end 30. Opposite of the discharge end 30 is a closure end 32, sealing the material (not shown) within the pouch 24. The fitment 28 includes an end wall 34 and a connector 36. The end wall 34 and connector 36 are preferably molded together and the fitment 28 is attached to the flexible sidewall 26 of the pouch 24. The connector 36 forms means for releasable attachment of the nozzle 14 to the fitment 28. The attachment means may take the form of a screw thread 38 that engages a corresponding connector thread formed on the internal surface of the nozzle 14. Other forms of attachment are also possible.

Figure 3:
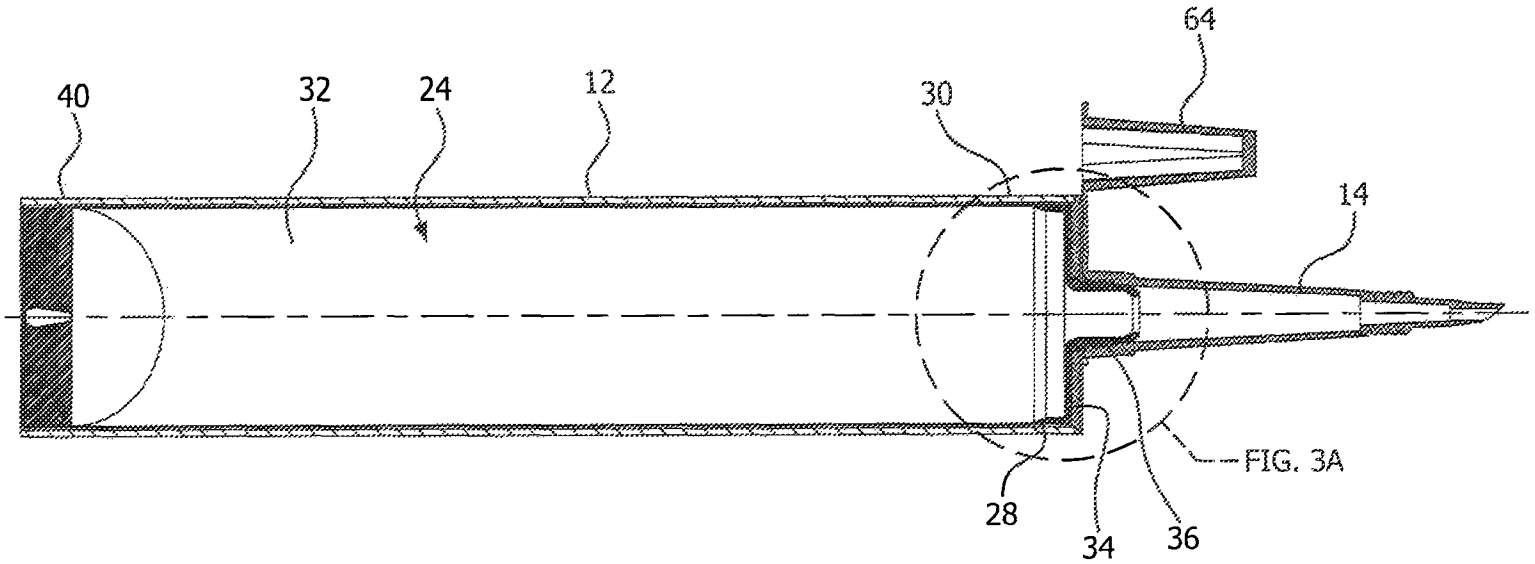
FIG. 3 shows a cross-sectional view of the device as shown in FIG. 2.
Figure 3A:
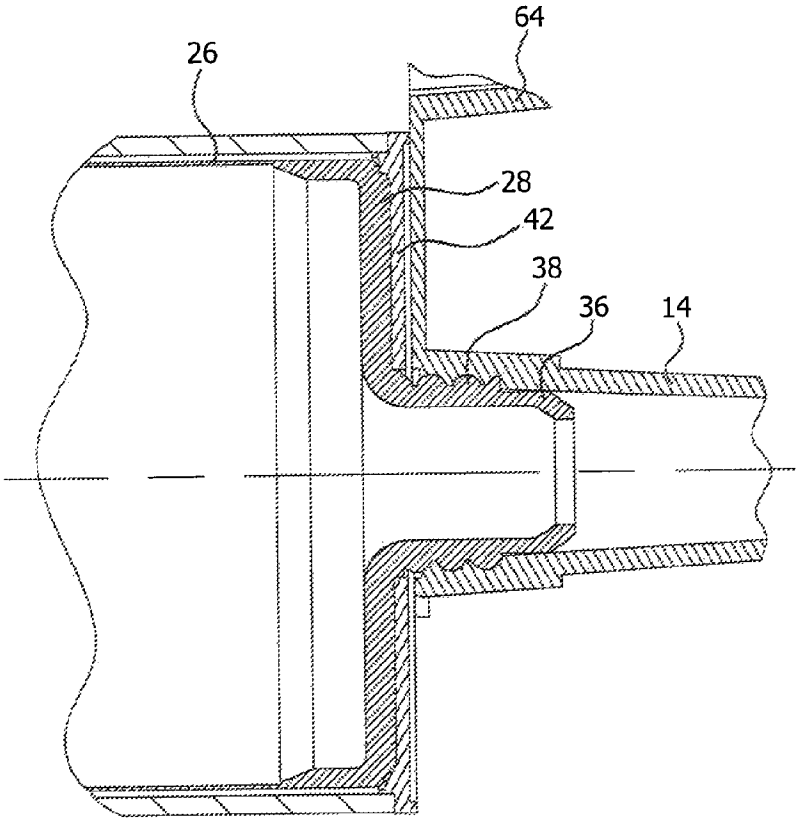
FIG. 3A shows an enlarged cross-sectional view of the discharge end of the device as shown in FIG. 3.

As shown in cross-section FIGS. 3 and 3A, the discharge end 30 of the pouch 24 is inserted into an open end 40 of the tube 12, with the fitment 28 moved into engagement with a tube end wall 42. The tube end wall 42 includes an opening 44 (see FIG. 2) for receipt of the connector 36 on the fitment 28. The connector 36 extends through the opening 44 and beyond the end wall 42, to be engaged by the nozzle 14.

Figure 4:
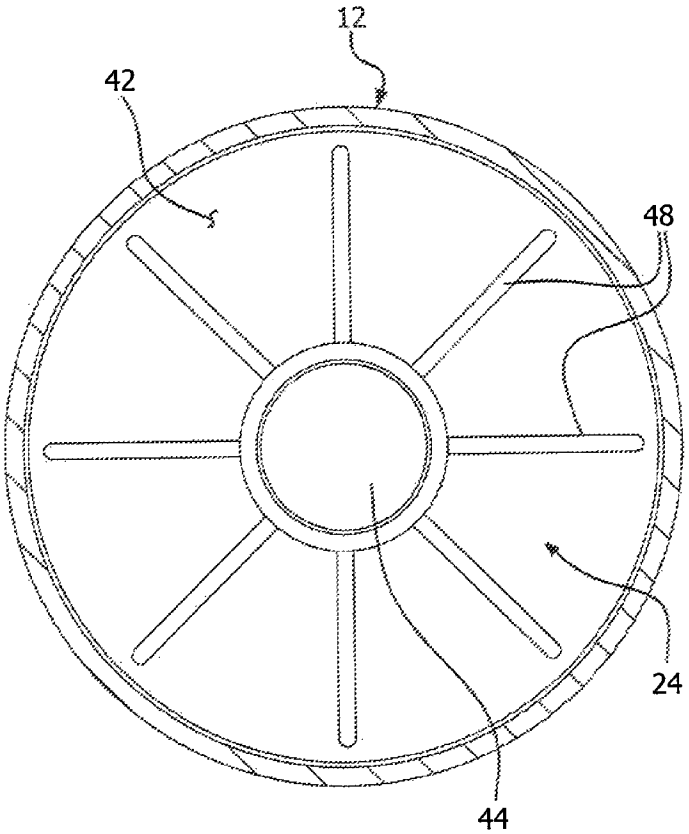
FIG. 4 is a view of the dispensing end of the outer tube portion of the device as taken along line 4-4 in FIG. 2.

As shown in FIG. 2, the end wall 42 of the fitment 28 includes a series of ridges 46 positioned around the connector 36. In FIG. 4, there is shown a series of correspondingly positioned grooves 48 formed on the inside surface of the tube end wall 42. Upon insertion of the pouch 24 within the tube 12, the ridges 46 engage within the grooves 48 to frictionally maintain the rotational position of the pouch 24 within the tube 12. Other arrangements for fixing the position of the pouch within the tube are possible, including the switch of the position of the ridges and grooves on the relevant parts.

Figure 5:
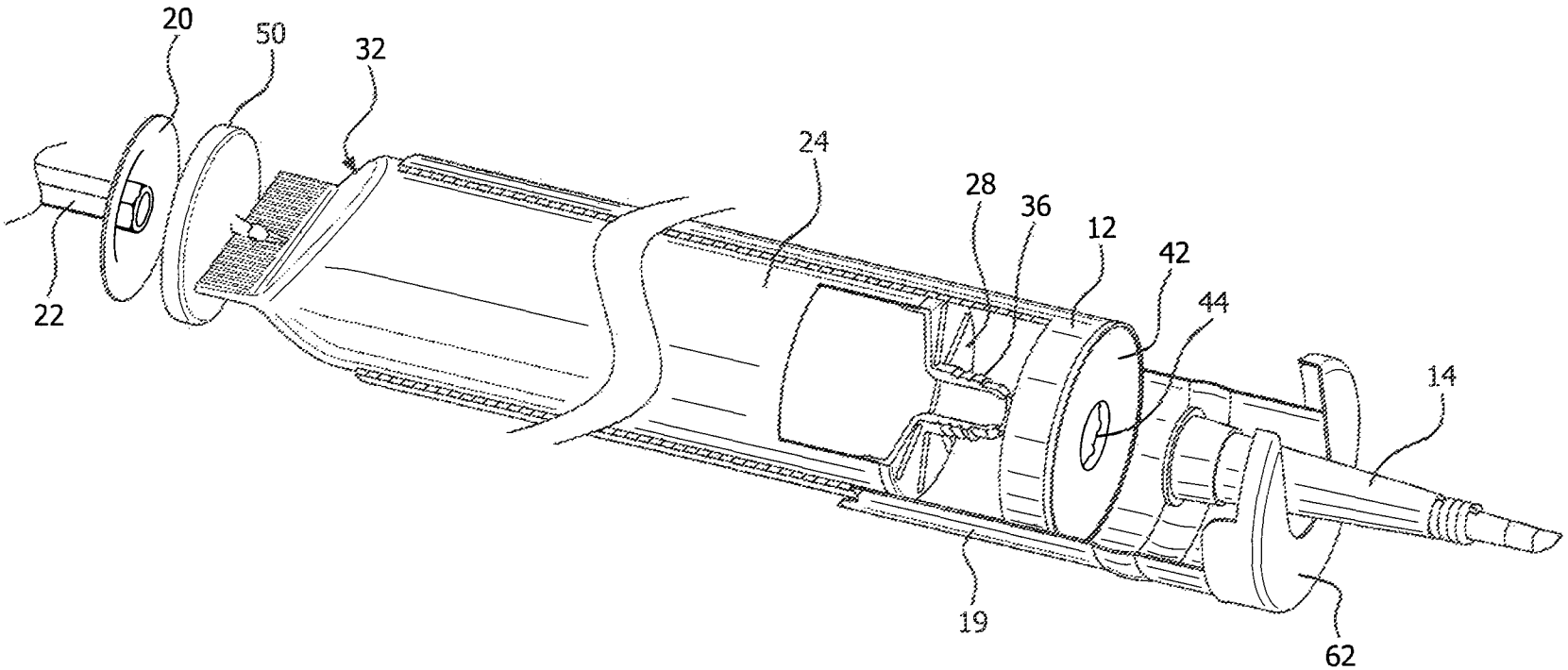
FIG. 5 shows a partial assembly of the device and the dispensing activation mechanism, with portions removed for illustration purposes.
Figure 6:
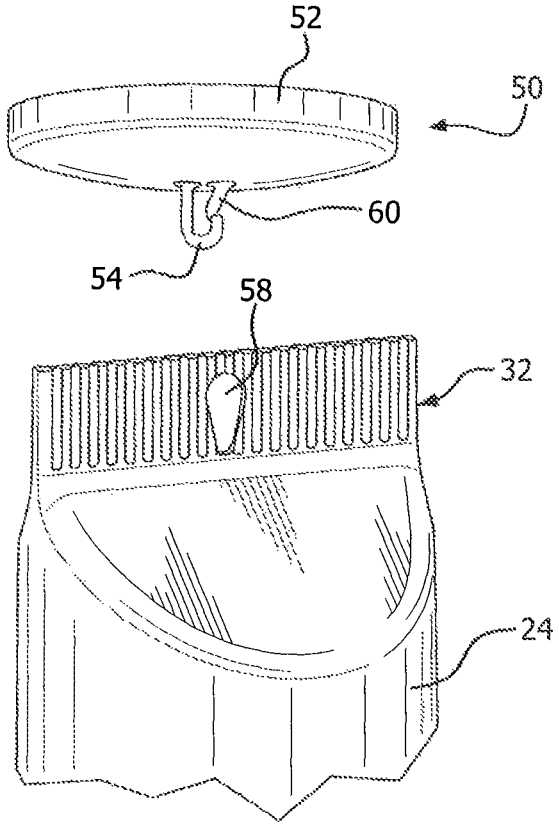
FIG. 6 is a perspective view of a partial assembly of a plunger cap and a closure end of a removable pouch portion of the device.
Figure 7:
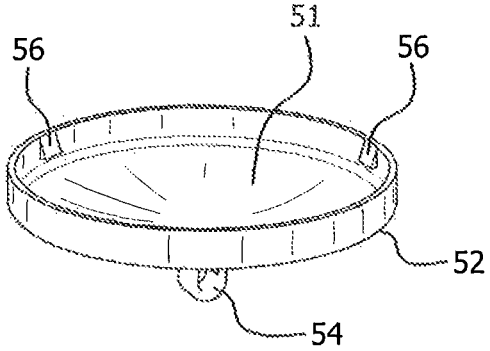
FIG. 7 is an alternate perspective view of the plunger cap portion of FIG. 6.

In FIG. 5, there is shown a partial assembly of the cartridge 10 within the discharge mechanism 16. The plunger 20 is connected to the shaft 22. The plunger 20 engages a pouch clip 50. The pouch clip 50 includes a receiving disk portion 52 and a projection hook 54. The disk 52 and hook 54 portions of the disk 52 are shown in more detail in FIGS. 6 and 7. In FIG. 6, the disk 52 is positioned in alignment with the discharge end 30 of the pouch 24. The hook 54 is in turn aligned with a clip hole 58 formed in the sealed end 32 of the pouch 24. During assembly, the hook 54 preferably engages the hole 58 and a spring arm 60 on the hook 54 maintains the disk 52 engaged with the pouch 24. In FIG. 7, engagement tabs 56 are shown on the inside edge of the disk 52. Preferably, disk 52 and plunger 20 are sized such that the plunger 20 is press-fit into the well 51 of the disk 52 (on the side opposite of the hook 54). The tabs 56 serve to retain the disk 52 engaged with the plunger 20. Other engagement means for removably securing the piston to the end of the tube are possible. Alternate structures may be formed on the tube end, with various gripping devices provided on the disk or similar device.

Returning to FIG. 5, during operation of the discharge mechanism, the user squeezes the trigger (18, FIG. 1) which in turn causes the shaft 22 to move the plunger 20 towards the dispensing end 62. The movement of the plunger 20 pushes the pouch clip 50 and in turn moves the sealed end 32 of the pouch 24 further into the tube 12. Movement of the plunger 20 and disk 52 against the pouch 24 creates a discharge pressure in the direction of the fitment 28. Once a seal (not shown) within an opening in the fitment end of the pouch 24 is broken, material retained within the pouch 24 may flow through the connector 36 and into the nozzle 12. The nozzle 12 is provided with a tapered body and an opening is provided at the narrow end. A separable sealing cap 64 is shown as attached to the nozzle member 12. The cap may be separated from the nozzle body and placed on the tapered end of the nozzle 14 to seal the cartridge 10 after partial use.

After exhaustion of the material in the pouch 24, or upon an intermediate desire to remove the pouch 24, disassembly of the cartridge 10 is possible. First, the piston 20 nozzle is removed from the cartridge 10. The piston 20 is then withdrawn from within the tube 12. The pouch clip structure 50 retains its connection with the piston 20 and withdraws the pouch from the tube. The retention of the plunger on the end of the pouch greatly assists in removal of the used pouch from the interior of the tube. Once withdrawn, the hook 54 may be removed and the pouch 24 disposed of (or stored) as desired. In addition, a new pouch may be provided for use within the reusable tube 12 to form a completed cartridge assembly 10.

The present construction may serve to reduce the overall cost of a cartridge assembly and my further reduce the associated waste. The materials used for the outer tube may differ from a conventional molded tube due to the barrier formed by the internal pouch. Hence, the tube is not required to be chemically compatible with the material stored therein. The pouch prevents contact between the material and the tube. The pouch material is contemplated to be formed from a flexible material, which may result in a further overall cost reduction. In addition, the graphic capability of flexible plastics is contemplated to be greater than those presently available for rigid plastic tubes.

The present assembly has been described and illustrated with respect to a number of exemplary embodiments thereof. It should be understood by those skilled in the art from the foregoing that various other changes, omissions and additions may be made therein, without departing from the spirit and scope of the contemplated invention, with the scope of the invention being defined by the foregoing claims.

What is claimed is:

1. A device for storing and dispensing a flowable material, the device formed for operation along with a dispensing mechanism having a plunger, a driving mechanism for linearly moving the plunger in a controlled manner, and a retaining body, the device comprising:

a cartridge assembly comprising a reusable cylindrical hollow tube, the hollow tube dimensionally formed to fit within the retaining body of the dispensing mechanism, the hollow tube being open at an open first end and having an end wall closing a second end, opposite the open first end;

a compressible pouch for storing a quantity of the flowable material; and a nozzle having attachment means thereon for removable attachment of the nozzle to the pouch, the nozzle directing discharge of the flowable material from the pouch, the hollow tube defining an interior passage for receipt of the pouch and for receipt of the plunger of the dispensing mechanism during linear movement thereof, the pouch defining an outer dimension less than an internal dimension of the interior passage of the hollow tube, the pouch removably positioned within the hollow tube, the pouch having a fitment at a fitment first end and an opposite closure end, the fitment having engagement elements formed for cooperation with the hollow tube upon insertion of the pouch into the interior passage, and connecting means for removably connecting to the attachment means on the nozzle, the end wall of the hollow tube including an internal surface having corresponding engagement elements formed for cooperation with and frictional engagement of the engagement elements of the fitment, the cooperation of the engagement elements of the fitment with the corresponding engagement elements of the internal surface of the end wall fixing a rotative position of the pouch with respect to the hollow tube during linear movement of the plunger of the dispensing mechanism, wherein the nozzle is attached to the fitment, and wherein the driving mechanism of the dispensing mechanism is received within the open first end of the hollow tube and engages the closure end of the pouch, the linear movement of the plunger compressing the pouch within the hollow tube and forcing the flowable material from the pouch through the nozzle.

2. The device of claim 1, wherein the fitment of the pouch comprises an exterior surface having threads thereon forming the connecting means.

3. The device of claim 2, wherein the nozzle comprises an interior surface having threads thereon forming the attachment means for removably connecting to the threads on the fitment.

4. The device of claim 1, wherein the engagement elements on the fitment of the pouch comprises a plurality of projecting ridges.

5. A device for storing and dispensing a flowable material, the device formed for operation along with a dispensing mechanism having a plunger, a driving mechanism for linearly moving the plunger in a controlled manner, and a retaining body, the device comprising:

a cartridge assembly comprising a reusable hollow tube, the hollow tube dimensionally formed to fit within the retaining body of the dispensing mechanism, the hollow tube being open at an open first end and having an end wall closing a second end, opposite the open first end;

a compressible pouch for storing a quantity of the flowable material; and a nozzle having attachment means thereon for removable attachment of the nozzle to the pouch, the nozzle formed for directing discharge of the flowable material from the pouch, the hollow tube defining an interior passage for receipt of the pouch and for receipt of the plunger of the dispensing mechanism during linear movement thereof, the pouch defining an outer dimension less than an internal dimension of the interior passage of the hollow tube, such that the pouch is removably positioned within the hollow tube, the pouch having a fitment at a fitment first end and an opposite closure end, the fitment having engagement means for cooperation with the hollow tube upon insertion of the pouch into the interior passage, and connecting means for removably connecting to the attachment means on the nozzle, wherein the nozzle is secured to the fitment by the interaction of the connecting means and the attachment means, the end wall of the hollow tube having an internal surface, including a corresponding engagement means for cooperation with the engagement means of the pouch, the cooperation fixing a rotative position of the pouch within the hollow tube, wherein the plunger and the driving mechanism of the dispensing mechanism is received within the open first end of the hollow tube and engages the closure end of the pouch, the linear movement of the plunger compressing the pouch within the hollow tube and forcing the flowable material from the pouch, through the nozzle, wherein the engagement means of the fitment comprises a plurality of projecting ridges, and wherein the corresponding engagement means on the internal surface of the end wall comprises a plurality of groves, the plurality of projecting ridges of the fitment and the plurality of grooves on the end wall engage one another and frictionally fixing a rotative position of the pouch within the hollow tube.

6. The device of claim 1, further comprising securing means for removably securing the plunger to the closure end of the pouch.

7. The device of claim 6, wherein the securing means comprises an engagement disk formed for removable attachment to the plunger, and a device for engaging the closure end of the pouch.

8. The device of claim 7, wherein the closure end of the pouch comprises a hole therein and wherein the engagement disk comprises a hook, the hole within the closure end of the pouch engaged by the hook on the engagement disk.

9. The device of claim 1, wherein the pouch comprises a flexible sidewall, and wherein the fitment is secured to the flexible sidewall at the fitment first end of the pouch.

10. The device of claim 1, wherein the hollow tube comprises a molded cylindrical sidewall, and the end wall is integrally molded with the molded cylindrical sidewall.

11. A cartridge assembly for storing and dispensing a flowable material, the cartridge assembly formed for operation along with a dispensing gun having a plunger, an elongated retaining body, and a driving mechanism for linearly moving the plunger in a controlled manner along a portion of the retaining body, the cartridge assembly comprising:

an elongated, hollow tube defined by a cylindrical sidewall formed about a central longitudinal axis, the hollow tube having an open first end, an end wall at an opposite end, and an opening in the end wall, the hollow tube dimensionally formed to fit within the retaining body of the dispensing gun and defining an interior passage for receipt of the plunger of the dispensing gun during linear movement of the plunger, an internal surface of the end wall of the hollow tube having an engagement structure thereon;

a pouch for storing a quantity of the flowable material, the pouch having a flexible sidewall, a fitment first end and a closed end, a fitment secured to the fitment first end of the pouch and the closed end positioned opposite the fitment first end, the fitment forming a pouch end wall and having a discharge opening therein in communication with the flowable material within the pouch, the flexible sidewall of the pouch defining an outer dimension that is less than an internal dimension of the interior passage of the hollow tube, such that the pouch is removably positioned within the hollow tube, an external surface of the fitment having an engagement structure thereon formed in a matching pattern for frictional cooperation with the engagement structure on the end wall of the hollow tube;

a nozzle having attachment means thereon for removable attachment of the nozzle to the fitment adjacent the discharge opening and for directing discharge of the flowable material from the pouch; and an engagement disk for removably securing the plunger to the closed end of the pouch, the engagement disk having a fastener for securing the engagement disk to the closed end of the pouch, wherein, during operation of the dispensing gun, the plunger is received within the hollow tube and engages the closed end of the pouch, the linear movement of the plunger compresses the pouch within the hollow tube and forces the flowable material from the pouch, through the discharge opening and through the nozzle, and the frictional cooperation of the engagement structures on the end wall of the hollow tube and on the fitment of the pouch engaging one another to substantially fix a rotational position of the pouch within the hollow tube.

12. The cartridge assembly of claim 11, wherein the closed end of the pouch comprises a hole therein and wherein the fastener comprises an engagement hook supported on the engagement disk.

13. The cartridge assembly of claim 11 wherein the fitment comprises a projection surrounding the discharge opening, and wherein the attachment means attaches the nozzle to the projection.

14. The cartridge assembly of claim 13, wherein the projection comprises threads and the attachment means on the nozzle comprises a correspondingly threaded portion.

15. A cartridge assembly for storing and dispensing a flowable material, the cartridge assembly formed for operation along with a dispensing gun having a plunger, an elongated retaining body, and a driving mechanism for linearly moving the plunger in a controlled manner along a portion of the retaining body, the cartridge assembly comprising:

an elongated, hollow tube defined by a cylindrical sidewall formed about a central longitudinal axis, the hollow tube having an open first end, an end wall at an opposite end, and an opening in the end wall, the hollow tube dimensionally formed to fit within the retaining body of the dispensing gun and defining an interior passage for receipt of the plunger portion of the dispensing gun during linear movement of the plunger, an internal surface of the end wall of the hollow tube having an engagement structure thereon;

a pouch for storing a quantity of flowable material, the pouch having a flexible sidewall, a fitment first end and a closed end, a fitment secured to the fitment first end of the pouch, and the closed end positioned opposite of the fitment first end, the fitment forming a pouch end wall and having a discharge opening therein in communication with the flowable material within the pouch, the sidewall of the pouch defining an outer dimension that is less than internal dimension of the interior passage of the hollow tube, such that the pouch is removably positioned within the hollow tube, an external surface of the fitment having an engagement structure thereon formed in a pattern for frictional cooperation with the engagement structure on the internal surface of the end wall of the hollow tube;

a nozzle having attachment means thereon for removable attachment of the nozzle to the fitment adjacent the discharge opening, and the nozzle formed for directing discharge of the flowable material from the pouch; and an engagement disk for removably securing the plunger to the closed end of the pouch, the engagement disk having a fastener for securing the engagement disk to the closed end of the pouch, wherein, during operation of the dispensing gun, the plunger is received within the interior passage of the hollow tube and engages the engagement disk, and linear movement of the plunger compresses the pouch within the hollow tube and forces the flowable material from the pouch, through the discharge opening and through the nozzle, and the engagement structure on the internal surface of the end wall of the hollow tube and the engagement structure on the fitment engage one another to substantially fix a rotational position of the pouch within the interior passage of the hollow tube, and the engagement structure on the internal surface of the end wall of the hollow tube comprises a plurality of groves formed within the internal surface of the end wall and the engagement structure on the fitment comprises a correspondingly positioned plurality of ridges, and the grooves formed to receive the ridges to fix the rotational position of the fitment relative to the end wall of the hollow tube.

16. A cartridge assembly for storing and dispensing a flowable material, the cartridge assembly formed for operation along with a dispensing gun having a plunger, a driving mechanism for linearly moving the plunger in a controlled manner, and a retaining body, the cartridge assembly comprising:

an elongated, hollow tube defined by a cylindrical sidewall formed about a central longitudinal axis, the hollow tube having an open first end, an end wall at a second end opposite the open first end, and an opening in the end wall, the hollow tube dimensionally formed to fit within the retaining body of the dispensing gun and defining an interior passage for receipt of the plunger during linear movement thereof;

a pouch for storing a quantity of flowable material, the pouch having a flexible sidewall, a fitment first end and a closed end, a fitment secured to the fitment first end of the pouch and the closed end positioned opposite the fitment first end, the fitment forming a pouch end wall and having a discharge opening therein, the pouch defining an outer dimension that is less than a transverse dimension of the interior passage of the hollow tube, such that the pouch is removably positioned within the hollow tube; and a nozzle having attachment means thereon for removable attachment of the nozzle to the discharge opening of the pouch and for directing discharge of the flowable material from the pouch, an external surface of the fitment of the pouch and an internal surface of the end wall of the hollow tube having at least one projecting ridge and at least one groove, the at least one projecting ridge positioned for cooperative engagement with at least one groove upon insertion of the pouch within the hollow tube, and the engagement of the at least one projecting ridge with the at least one groove fixing a rotational position of the pouch within the interior passage of the hollow tube, wherein, during operation of the dispensing gun, the driving mechanism is received within the interior passage of the hollow tube and engages the closed end of the pouch and the linear movement of the plunger compresses the pouch within the hollow tube and forces the flowable material from the pouch, through the discharge opening and through the nozzle.

17. The cartridge assembly of claim 16, further comprising a piston securing engagement disk for removable attachment to the piston and a gripping device for engagement of the pouch.

18. The cartridge assembly of claim 17, wherein the closed end of the pouch comprises a hole therein for receipt of the gripping device.

19. A cartridge assembly comprising a rigid, plastic, hollow tube defined by an elongated sidewall formed about a longitudinal axis, and an open first end, a molded plastic end wall positioned on a second end of the hollow tube, the second end positioned opposite the open first end, the end wall having an opening therein, the opening having an axis aligned with the longitudinal axis of the sidewall of the hollow tube;

a pouch for storing a quantity of a flowable material, the pouch having a flexible sidewall, a fitment secured to a fitment first end of the pouch, and a closed second end of the pouch, the fitment forming a pouch end wall and having a hollow projection extending therefrom, the hollow projection dimensioned to extend through the opening in the end wall positioned on the hollow tube upon insertion of the pouch into the hollow tube through the open first end of the hollow tube and to communicate with the flowable material stored within the pouch;

a nozzle removably attachable to the hollow projection on the fitment of the pouch, the nozzle formed for directing a discharge of the flowable material from the pouch and through the hollow projection of the fitment, the pouch defining an outer dimension less than an internal dimension of the an interior of the hollow tube, the pouch removably positioned within the interior of the hollow tube with the fitment positioned adjacent the end wall; and an interior surface of the end wall and an exterior surface of the fitment each having matching ridged structures formed thereon for cooperative frictional engagement with one another to fix a rotational position of the pouch within the interior of the hollow tube.

20. The cartridge assembly of claim 19, wherein the hollow projection of the fitment comprises an exterior surface having threads thereon, and the nozzle comprises an interior surface having complimentary threads thereon for engagement with the external threads of the hollow projection of the fitment.

21. A cartridge assembly comprising a rigid, plastic, hollow tube defined by an elongated sidewall formed about a longitudinal axis, an open first end, and a hollow interior, a molded plastic end wall positioned on the hollow tube at an end opposite of the open first end, the end wall having an opening therein, the opening having an axis aligned with the longitudinal axis of the sidewall;

a pouch for storing a quantity of a flowable material, the pouch having a flexible sidewall, a fitment secured to a fitment first end and a closed end located opposite of the fitment, the fitment forming a pouch end wall and having a projection extending therefrom, the projection formed to communicate with the flowable material stored within the pouch, the projection dimensioned to extend through the opening in the end wall positioned on the hollow tube upon insertion of the pouch into the hollow interior of the hollow tube;

a nozzle removably attachable to the projection on the fitment, the nozzle formed for directing the discharge of the flowable material from the pouch and through the projection on the fitment;

the pouch defining an outer dimension less than an internal dimension of the hollow interior of the hollow tube, the pouch removably positioned within the hollow tube with the fitment positioned adjacent the end wall; and an interior surface of the end wall and an exterior surface of the fitment having structures formed thereon for cooperative engagement with one another to fix a rotative position of the pouch within the hollow interior of the hollow tube upon insertion of the pouch into the hollow interior of the hollow tube, wherein the cooperative engagement structures on the fitment of the pouch and on the end wall of the hollow tube comprise a plurality of projecting ridges and a correspondingly formed plurality of receiving grooves, the ridges engaging within the receiving grooves for fixing the rotative position of the pouch within the hollow tube.

22. The cartridge assembly of claim 21, further comprising an engagement disk dimensioned to fit within the hollow interior of the hollow tube, the engagement disk having securing means thereon for releasably securing the engagement disk to the closed end of the pouch.

* * * * *